US009108299B2

(12) United States Patent
Moren et al.

(10) Patent No.: US 9,108,299 B2
(45) Date of Patent: Aug. 18, 2015

(54) SELF-CONTAINED FIBROUS BUFFING ARTICLE

(75) Inventors: Louis S. Moren, Mahtomedi, MN (US); Scott M. Mevissen, White Bear Lake, MN (US); Jasmeet Kaur, Woodbury, MN (US); Jaime A. Martinez, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/119,035

(22) PCT Filed: Jun. 13, 2012

(86) PCT No.: PCT/US2012/042177

§ 371 (c)(1),
(2), (4) Date: Nov. 20, 2013

(87) PCT Pub. No.: WO2012/174063

PCT Pub. Date: Dec. 20, 2012

(65) Prior Publication Data

US 2014/0099871 A1 Apr. 10, 2014

Related U.S. Application Data

(60) Provisional application No. 61/496,778, filed on Jun. 14, 2011.

(51) Int. Cl.

| | |
|---|---|
| ***B24D 11/00*** | (2006.01) |
| ***B24D 3/28*** | (2006.01) |
| ***B24D 13/04*** | (2006.01) |
| ***B24D 3/34*** | (2006.01) |
| ***B24D 13/06*** | (2006.01) |
| ***B24D 13/08*** | (2006.01) |

(52) U.S. Cl.

CPC .. *B24D 3/34* (2013.01); *B24D 3/28* (2013.01); *B24D 11/00* (2013.01); *B24D 13/04* (2013.01); *B24D 13/06* (2013.01); *B24D 13/08* (2013.01)

(58) Field of Classification Search

CPC .... B24D 11/00; B24D 11/001; B24D 11/005; B24D 3/28; B24D 3/32; B24D 13/04; B24D 13/06; B24D 13/08

USPC ..... 451/532, 533, 536; 51/295, 297, 298, 51/300, 304, 306, 307

See application file for complete search history.

(56) References Cited

U.S. PATENT DOCUMENTS

| | | | |
|---|---|---|---|
| 1,954,655 | A | 4/1934 | Strafford |
| 1,976,380 | A | 10/1934 | Wildinson |
| 2,004,623 | A | 6/1935 | Yohe |
| 2,106,610 | A | 1/1938 | Kreilick |

(Continued)

FOREIGN PATENT DOCUMENTS

| | | |
|---|---|---|
| DE | 2 720 829 | 11/1978 |
| EP | 1 046 466 A2 | 10/2000 |

(Continued)

*Primary Examiner* — Eileen Morgan

(74) *Attorney, Agent, or Firm* — Scott A. Baum; David B. Patchett

(57) ABSTRACT

A self-contained fibrous buffing article including at least one layer of a fibrous nonwoven fabric; the nonwoven fabric having a hardened adherent coating including a crosslinked binder, abrasive particles, and a lubricant blend; and the lubricant blend including at least a fatty acid, mineral oil and glycerin.

14 Claims, 6 Drawing Sheets

(56) References Cited

U.S. PATENT DOCUMENTS

| | | | | | |
|---|---|---|---|---|---|
| 2,767,524 | A | | 10/1956 | Schaffner | |
| 3,080,689 | A | | 3/1963 | Churchill | |
| 3,120,724 | A | | 2/1964 | Mockiewicz | |
| 3,529,945 | A | | 9/1970 | Charvat | |
| 3,653,859 | A | | 4/1972 | Zimmer, Jr. | |
| 3,991,526 | A | * | 11/1976 | Frank et al. | 451/490 |
| 4,839,005 | A | | 6/1989 | Gotoh | |
| 4,842,619 | A | * | 6/1989 | Fritz et al. | 51/295 |
| 4,903,440 | A | * | 2/1990 | Kirk et al. | 51/298 |
| 5,178,646 | A | | 1/1993 | Barber, Jr. | |
| 5,346,516 | A | * | 9/1994 | Alkhas et al. | 51/296 |
| 5,378,251 | A | | 1/1995 | Culler | |
| 5,554,068 | A | | 9/1996 | Carr | |
| 5,700,302 | A | | 12/1997 | Stoetzel | |
| 5,725,617 | A | * | 3/1998 | Hagiwara et al. | 51/295 |
| 5,942,015 | A | | 8/1999 | Culler | |
| 5,973,892 | A | * | 10/1999 | Hasegawa et al. | 360/128 |
| 6,069,776 | A | * | 5/2000 | Hasegawa et al. | 360/128 |
| 6,258,138 | B1 | * | 7/2001 | DeVoe et al. | 51/298 |
| 6,352,567 | B1 | * | 3/2002 | Windisch et al. | 51/298 |
| 6,645,263 | B2 | * | 11/2003 | Keipert et al. | 51/298 |
| 6,672,952 | B1 | | 1/2004 | Masmar | |
| 7,160,183 | B2 | | 1/2007 | Weber | |
| 2003/0194962 | A1 | | 10/2003 | Weber | |
| 2007/0010828 | A1 | * | 1/2007 | Eknoian et al. | 606/131 |
| 2008/0167597 | A1 | * | 7/2008 | Dougherty | 604/12 |
| 2010/0159805 | A1 | * | 6/2010 | Goldsmith et al. | 451/28 |
| 2010/0248592 | A1 | | 9/2010 | Israelson | |
| 2013/0345721 | A1 | * | 12/2013 | Menke et al. | 606/131 |

FOREIGN PATENT DOCUMENTS

| | | |
|---|---|---|
| JP | 59-001169 | 1/1984 |
| JP | 62-084968 | 4/1987 |
| JP | 09-254041 | 9/1997 |
| JP | 2007-290061 | 11/2007 |
| WO | 2005/110675 | 11/2005 |
| WO | 2012/082395 | 6/2012 |
| WO | 2012/082396 | 6/2012 |

* cited by examiner

SELF-CONTAINED FIBROUS BUFFING ARTICLE

CROSS REFERENCE TO RELATED APPLICATIONS

This application is a national stage filing under 35 U.S.C. 371 of PCT/US2012/042177 filed Jun. 13, 2012, which claims priority to U.S. Provisional Patent Application No. 61/496,778, filed Jun. 14, 2011, the disclosures of which are incorporated by reference in their entirety herein.

BACKGROUND

Buffing wheels or buffs are generally formed from layers of a fibrous material which are stacked or fastened together. Fastening methods include, for example, compression, sewing, stapling, adhesive bonding, plastic or metal clinch rings, and combinations thereof. The buffing wheel is typically attached to a shaft and supported for rotation. Buffs have long been used to finish items such as machined parts, stamped parts, and cast articles which often have surfaces which must be modified, generally for aesthetic purposes. Buffing is a finishing process which is typically accomplished after more rigorous stock removal treatment of the surface. Buffs are typically rotated to obtain working surface speeds of from 1000 m/min to 3500 m/min.

Buffs are frequently categorized as either "cut" buffs or "color" buffs. A cut buff is more aggressive and is typically employed with a coarser buffing compound, a medium to high pressure between the buff and the work piece, and the work piece is advanced against the direction of rotation of the buff. This results in the refinement of scratches on the work piece and yields a uniform matte finish. A color buff is typically employed with a finer buffing compound, a medium to low pressure between the buff and the work piece, and the work piece is advanced in the direction of rotation of the buff. The color buff application results in a further refinement of scratches in the surface of the work piece and yields a reflective, mirror-like finish.

SUMMARY OF THE INVENTION

Buffs are most often employed to refine surfaces by a three-body abrasion mechanism. Driven buffs transmit energy to a work piece, but the abrading action is provided by an abrasive composition "buffing compound" that is peripherally applied, but not bound, to the buff's surface. Unbonded buffing compounds situated between the work piece and the buff's surface refines the work piece surface resulting in fewer and smaller scratches being imparted to the work piece surface as the buffing continues. While such three-body systems produce the required finishes, the buffing compound must be frequently applied to achieve a consistent finish, can be undesirably transferred onto adjacent surfaces, and leaves a residue on the work piece surface which then must be removed. Attempts to resolve these deficiencies by employing a two-body abrading system, wherein the abrasive composition is hardened to the working surfaces of the buff or pre-impregnated instead of peripherally applied, have been unsuccessful for cut and color buffs. Hence there is a need for cut and/or color buffs having a pre-impregnated abrasive composition for buffing such that the need to apply buffing compound to the buffing wheel is substantially eliminated.

The present invention relates to self-contained fibrous buffing articles that are functional without the application of external buffing compounds to the periphery or surfaces of the buffing wheel. Hence, in one embodiment, the invention resides a self-contained fibrous buffing article comprising at least one layer of a fibrous nonwoven fabric comprising lyocell fiber; the nonwoven fabric having a hardened adherent coating comprising a crosslinked binder, abrasive particles, and a lubricant blend; and the lubricant blend comprising at least a fatty acid, mineral oil and glycerin. In another embodiment, the invention resides in a self-contained fibrous buffing article comprising at least one layer of a fibrous nonwoven fabric comprising a majority of fibers 15 denier or less in size; the nonwoven fabric having a hardened adherent coating comprising a crosslinked binder, abrasive particles, and a lubricant blend; and the lubricant blend comprising at least a fatty acid, mineral oil and glycerin. The self-contained buff is capable of imparting bright finishes onto metal surfaces, has a long service life, and is resistant to fraying, dusting, smearing, and unraveling.

BRIEF DESCRIPTION OF THE DRAWINGS

It is to be understood by one of ordinary skill in the art that the present discussion is a description of exemplary embodiments only, and is not intended as limiting the broader aspects of the present disclosure, which broader aspects are embodied in the exemplary construction.

DEFINITIONS

Figure 1:
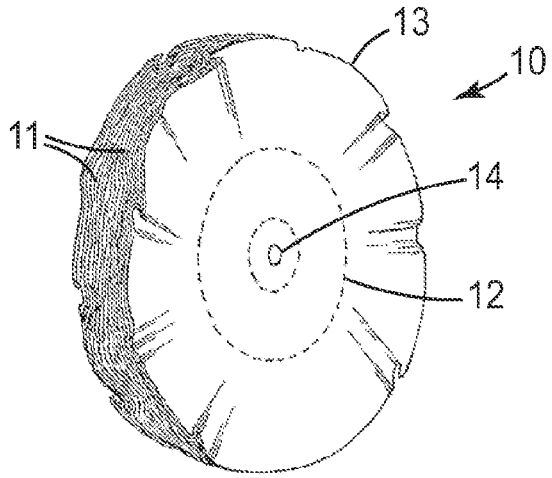
FIG. 1 illustrates one embodiment of a self-contained fibrous buffing article

As used herein, "self-contained fibrous buffing article" means a buffing article containing a pre-applied or pre-impregnated abrasive buffing composition to the fibrous material forming the buffing article. The abrasive buffing composition is suitable for cut or color buffing, and is applied to the buffing article by the manufacturer during the initial manufacturing of the buffing article. As such, the application of a buffing compound to the buffing article by an operator before first using or while using the buffing article to buff a work surface is not required.

As used herein, "hardening", when used to describe the solidification of a precursor, refers to curing (e.g., polymerization and/or cross-linking, thermally or otherwise), drying (e.g., driving off a volatile solvent) and/or simply by cooling.

As used herein, forms of the words "comprise", "have", and "include" are legally equivalent and open-ended. Therefore, additional non-recited elements, functions, steps or limitations may be present in addition to the recited elements, functions, steps, or limitations.

DETAILED DESCRIPTION

The self-contained fibrous buffing article comprises at least one layer of a fibrous nonwoven fabric impregnated with a prebond coating comprising at least a first crosslinkable binder precursor, and at least a second coating comprising abrasive particles, a lubricant, and an optional second crosslinkable binder precursor. The prebond coating and second coating form an adherent coating comprising the pre-impregnated abrasive buffing composition. In other embodiments, additional coatings may be applied that contribute to the adherent coating of the buffing article.

Nonwoven Fabric

Nonwoven fabrics useful in the practice of this invention may be made by any known web formation system. In some embodiments, the fabric may be spunbonded, hydroentangled, or melt blown. In some embodiments, the nonwoven fabric is a dry laid nonwoven fabric. In some embodiments, the nonwoven fabric is an air-laid nonwoven fabric. In some embodiments, the nonwoven fabric is formed by carding and cross-lapping. While web formation methods using staple fibers are typical, continuous filament systems such as spunbond or meltblown may be used. Useful staple fibers lengths include those between 0.75 inch (19 mm) and 4 inches (102 mm), inclusive. In some embodiments, a prebond coating may be applied to enhance the integrity of the nonwoven fabric.

The fiber component of the nonwoven fabric may be synthetic, man-made, or natural in origin. Exemplary synthetic fibers are polyester (such as poly(ethylene terephthalate) or poly(butylene terephthalate)), polyamide (such as poly(hexamethylene adipate) or polycaprolactam), and polyolefins (such as polyethylene or polypropylene). Exemplary man-made fibers include cellulose acetate, rayon, and lyocell. In some embodiments, natural fibers such as cotton, jute, ramie, and wool are useful alone or in combination. In some embodiments, blends of two, three, or even more fiber constituents may be used.

In some embodiments, fiber denier may be 0.1 denier (0.11 dtex) or greater. In some embodiments, fiber size may be 20 denier (22.5 dtex) or less, 15 denier or less, 6 denier or less, or 3 denier or less. In some embodiments, mixtures of two or more fiber deniers or ranges may be useful. In some embodiments, a majority, 70%, 80%, 90%, or 95% of the fibers forming the nonwoven are selected to have a fiber size from 0.1 denier to 20, 15, 6, or 3 denier.

In some embodiments, the nonwoven fabric includes lyocell fiber. In some embodiments, the nonwoven fabric is at least 30 wt % lyocell fiber, or at least 50 wt % lyocell fiber, or at least 70 wt % lyocell fiber. Other natural, manmade, or synthetic fibers may be also incorporated, including polyamide (e.g., nylon 6, nylon 6,6), polyester (e.g., polyethylene terephthalate, polybutylene terephthalate), rayon, cellulose acetate, or cotton. In some embodiments, the nonwoven fabric may contain melt-bondable fibers, including melt-bondable fibers that can be crosslinked after melt bonding to render them thermosetting.

The nonwoven fabric is prepared to have a basis weight from 50 g/m$^2$ to 500 g/m$^2$, or from 75 g/m$^2$ to 400 g/m$^2$, or from 100 g/m$^2$ to 300 g/m$^2$. The thickness of the nonwoven fabric is typically from 1 mm to 20 mm, or from 1 mm to 15 mm, or from 2 mm to 5 mm. In some embodiments, the nonwoven fabric is subsequently needle-tacked. In other embodiments, the nonwoven fabric may be subsequently calendered and/or otherwise thermally-treated (e.g., through-bonding).

Prebond Coating

The prebond coating comprises a first crosslinkable binder precursor. Suitable first crosslinkable binders are discussed later, but preferred cross linkable binders are polyurethanes. Useful prebond coatings are formulated to maximize the desired web properties (tear, tensile, flexibility) and provide the desired final product performance (e.g., cut, wear, finish) during use. Useful compositions of the prebond coating comprise 3-85 wt. %, 30-85 wt. %, 51-85 wt. %, and 70-85 wt. % binder precursor. The coating may be applied by any conventional means such as, for example, roll coating, spray coating, or saturation coating. After curing, a prebonded fibrous nonwoven fabric is obtained. In some embodiments, the prebond coating can also include abrasive particles, lubricants, and/or optional additives. In general, the prebond coating will comprise a majority of the cured crosslinkable binder applied to the cured buffing article.

In some applications, it may be advantageous to produce buffing articles comprising a prebonded fibrous nonwoven fabric without having subsequent coatings or any abrasive particles applied to the buff. Such "cleaning buffs" may optionally be employed to efficiently provide a final wiping and cleaning of the work piece after using a cut or color buff having abrasive particles. Alternately, buffing articles comprising a prebonded fibrous nonwoven fabric may be used like a traditional cotton buff with a buffing compound frequently applied by an operator during use.

Second Coating

The second coating comprises an aqueous dispersion of abrasive particles, a lubricant, and an optional second crosslinkable binder precursor. Useful second coatings are formulated to maximize the desired abrasive effects (cut or color buffing), maximize the buff's flexibility, and minimize both smearing (unwanted transfer of buffing components onto the work piece) and dusting during use. Useful compositions of the second coating are 0-50 wt. % binder precursor, 5-99 wt % lubricant, and 0-80 wt % mineral. The nonwoven fabric is coated with the second coating and other optional additives in one or more coating steps. The coatings may be applied by any conventional means such as, for example, roll coating, spray coating, or saturation coating. In some embodiments, three coatings are applied: a lubricant coating followed by a hardening step; a phenolic resin coating followed by a hardening step; and a lubricant coating followed by a hardening step. In some embodiments, the coatings are applied in at least two separate steps with the binder precursor and mineral applied and then hardened followed by the lubricant coating and hardening. In further embodiments, two lubricant coatings are applied and hardened.

Crosslinkable Binder Precursors

Suitable binder precursors for the first and second crosslinkable binders include polyurethane polymers or prepolymers, phenolic resins, and acrylics. In some embodiments, the first and second crosslinkable binders are selected to be different chemistries such as a phenolic resin and an acrylic. In other embodiments the first and second crosslinkable binders are the same chemistry, but may be applied at the same or different coating weights.

Examples of useful urethane prepolymers include polyisocyanates and blocked versions thereof. Typically, blocked polyisocyanates are substantially unreactive to isocyanate reactive compounds (e.g., amines, alcohols, thiols, etc.) under ambient conditions (e.g., temperatures in a range of from about 20 degrees C. to about 25 degrees C.), but upon application of sufficient thermal energy the blocking agent is released, thereby generating isocyanate functionality that reacts with the amine curative to form a covalent bond.

Useful polyisocyanates include, for example, aliphatic polyisocyanates (e.g., hexamethylene diisocyanate or trimethylhexamethylene diisocyanate); alicyclic polyisocyanates (e.g., hydrogenated xylylene diisocyanate or isophorone diisocyanate); aromatic polyisocyanates (e.g., tolylene diisocyanate or 4,4'-diphenylmethane diisocyanate); adducts of any of the foregoing polyisocyanates with a polyhydric alcohol (e.g., a diol, low molecular weight hydroxyl group-containing polyester resin, water, etc.); adducts of the foregoing polyisocyanates (e.g., isocyanurates, biurets); and mixtures thereof.

Useful commercially available polyisocyanates include, for example, those available under the trade designation "ADIPRENE" from Chemtura Corporation, Middlebury, Conn. (e.g., "ADIPRENE L 0311", "ADIPRENE L 100", "ADIPRENE L 167", "ADIPRENE L 213", "ADIPRENE L 315", "ADIPRENE L 680", "ADIPRENE LF 1800A", "ADIPRENE LF 600D", "ADIPRENE LFP 1950A", "ADIPRENE LFP 2950A", "ADIPRENE LFP 590D", "ADIPRENE LW 520", and "ADIPRENE PP 1095"); polyisocyanates available under the trade designation "MONDUR" from Bayer Corporation, Pittsburgh, Pa. (e.g., "MONDUR 1437", "MONDUR MP-095", or "MONDUR 448"); and polyisocyanates available under the trade designations "AIRTHANE" and "VERSATHANE" from Air Products and Chemicals, Allentown, Pa. (e.g., "AIRTHANE APC-504", "AIRTHANE PST-95A", "AIRTHANE PST-85A", "AIRTHANE PET-91A", "AIRTHANE PET-75D", "VERSATHANE STE-95A", "VERSATHANE STE-P95", "VERSATHANE STS-55", "VERSATHANE SME-90A", and "VERSATHANE MS-90A").

To lengthen pot-life, polyisocyanates such as, for example, those mentioned above may be blocked with a blocking agent according to various techniques known in the art. Exemplary blocking agents include ketoximes (e.g., 2-butanone oxime); lactams (e.g., epsilon-caprolactam); malonic esters (e.g., dimethyl malonate and diethyl malonate); pyrazoles (e.g., 3,5-dimethylpyrazole); alcohols including tertiary alcohols (e.g., t-butanol or 2,2-dimethylpentanol), phenols (e.g., alkylated phenols), and mixtures of alcohols as described.

Exemplary useful commercially available blocked polyisocyanates include those marketed by Chemtura Corporation under the trade designations "ADIPRENE BL 11", "ADIPRENE BL 16", "ADIPRENE BL 31", and blocked polyisocyanates marketed by Baxenden Chemicals, Ltd., Accrington, England under the trade designation "TRIXENE" (e.g., "TRIXENE BL 7641", "TRIXENE BL 7642", "TRIXENE BL 7772", and "TRIXENE BL 7774").

In some embodiments, the amount of urethane prepolymer present in a polyurethane binder coating is in an amount from 10 to 85 percent by weight, or from 20 to 60 percent by weight, or even from 40 to 70 percent by weight based on the total weight of the hardened coating composition, although amounts outside of these ranges may also be used.

Suitable amine curatives include aromatic, alkyl-aromatic, or alkyl polyfunctional amines, preferably primary amines. Examples of useful amine curatives include 4,4'-methylenedianiline; polymeric methylene dianilines having a functionality of 2.1 to 4.0 which include those known under the trade designations "CURITHANE 103", commercially available from the Dow Chemical Company, and "MDA-85" from Bayer Corporation, Pittsburgh, Pa.; 1,5-diamine-2-methylpentane; tris(2-aminoethyl)amine; 3-aminomethyl-3,5,5-trimethylcyclohexylamine (i.e., isophoronediamine), trimethylene glycol di-p-aminobenzoate, bis(o-aminophenylthio) ethane, 4,4'-methylenebis(dimethyl anthranilate), bis(4-amino-3-ethylphenyl)methane (e.g., as marketed under the trade designation "KAYAHARD AA" by Nippon Kayaku Company, Ltd., Tokyo, Japan); an unmodified aromatic amine curative believed to comprise 3,3' diethyl 4,4' diaminodiphenyl methane, marketed under the trade designation "LAPDX K-450" by Royce International, East Rutherford, N.J.; and bis(4-amino-3,5-diethylphenyl)methane (e.g., as marketed under the trade designation "LONZACURE M-DEA" by Lonza, Ltd., Basel, Switzerland), and mixtures thereof. If desired, polyol(s) may be added to the hardenable composition, for example, to modify (e.g., to retard) cure rates as required by the intended use.

The amine curative should be present in an amount effective (i.e., an effective amount) to cure the blocked polyisocyanate to the degree required by the intended application; for example, the amine curative may be present in a stoichiometric ratio of curative to isocyanate (or blocked isocyanate) in a range from 0.8 to 1.35 or in a range from 0.85 to 1.20.

Phenolic materials are useful binder precursors because of their thermal properties, availability, cost, and ease of handling. Resole phenolics have a molar ratio of formaldehyde to phenol of greater than or equal to one, typically from 1.5:1.0 to 3.0:1.0. Novolac phenolics have a molar ratio of formaldehyde to phenol of less than 1.0:1.0. Examples of commercially available phenolics include those known by the trade names DUREZ and VARCUM from Occidental Chemicals Corp., RESINOX from Monsanto, AROFENE from Ashland Chemical Co., and AROTAP from Ashland Chemical Co.

In some embodiments, the amount of phenolic binder precursor present in the phenolic binder coating is in an amount from 2 to 50 percent by weight, or in an amount from 5 to 40 percent by weight, or even in an amount from 5 to 35 percent by weight based on the total weight of the coating composition, although amounts outside of these ranges may also be used.

Emulsions of crosslinked acrylic resin particles may also find utility in the present invention.

Some binder precursors include a phenolic mixed with a latex. Examples of such latexes include materials containing acrylonitrile butadiene, acrylics, butadiene, butadiene-styrene, and combinations thereof. These latexes are commercially available from a variety of different sources and include those available under the trade designations RHOPLEX and ACRYLSOL commercially available from Rohm and Haas Company, FLEXCRYL and VALTAC commercially available from Air Products & Chemicals Inc., SYNTHEMUL, TYCRYL, and TYLAC commercially available from Reichold Chemical Co., HYCAR and GOODRITE commercially available from B. F. Goodrich, CHEMIGUM commercially available from Goodyear Tire and Rubber Co., NEOCRYL commercially available from ICI, BUTAFON commercially available from BASF, and RES commercially available from Union Carbide.

Lubricant

Examples of lubricants for use in the self-contained fibrous buffing article include fatty acids (e.g., stearic acid, lauric acid, palmitic acid, myristic acid, oleic acid, palmitoleic acid, linoleic acid, and linolenic acid), metallic salts of fatty acids (e.g., lithium stearate, zinc stearate), solid lubricants (e.g., poly(tetrafluoroethylene) (PTFE), graphite, and molybdenum disulfide), mineral oils and waxes (including micronized waxes), carboxylic acid esters (e.g., butyl stearate), poly(dimethylsiloxane) fluids, poly(dimethylsiloxane) gums, and simple polyol compounds such as glycerin, and combinations thereof. Such lubricants and commercial sources are known in the art. Other suitable lubricants may be apparent to those skilled in the art after reviewing the present disclosure.

Useful lubricants include, for example, "INDUSTRENE 4516" (from PCM Biogenics, Memphis, Tennesee), "LIC17" (from Ashland, Inc., Covington, Ky.), mineral oil (from Univar USA, Redmond, Wash.), "ZINCUM SW", "ZINCUM AV", "CEASIT SW" and "CEASIT AV" (from Baerlocher Do Brasil S.A, Americana, SP, Brazil), "COMAX A", "COMAX T", "QUIMIPEL COAT 9327" and "QUIMIPEL COAT 9330" (from Quimipel Industria Quimica LTDA, Piracaia, SP, Brazil), "Natural Graphite" (from Nacional de Grafite LTDA, Itapecerica, MG, Brazil), "Mineral Oil USP Grade Agecom and Drakeol" (from Agecom Produtos de Petroleo, Mauá, SP, Brazil), KAYDOL White Mineral Oil (from Sonneborn, Mahwah, N.J.) and glycerin (from Acme Hardesty Oleochemicals, Blue Bell, Pa.).

In one embodiment, three lubricants in combination forming a lubricant blend were found highly effective. In particular, varying the weight percentages of the fatty acid, mineral oil, and glycerin can be used to reduce smearing and improve the polishing performance of the buffing article as discussed in the Examples.

Abrasive Particles

Suitable abrasive particles are those useful in buffing operations. The abrasive particles may be of any suitable composition, but those comprising chromium oxide, titanium oxide, aluminum oxide, calcined micronized aluminum oxide, iron oxide or silicon carbide are typical. Appropriate abrasive particle size distributions include those with median particle diameters of no greater than 50 micrometers, no greater than 30 micrometers, or no greater than 15 micrometers.

Examples of useful abrasive particles include "E2616 GREEN" (from Akrochem Corporation, Akron, Ohio), "KRONOS 2310" (from Kronos Inc., Houston, Tex.), "BK-5099" (from Elementis Pigments Inc., Fairview Heights, Ill.), "MICROGRIT WCA" or MICROGRIT PXA (from Micro Abrasives Corporation, Westfield, Mass.), and combinations thereof.

Other Optional Additives

Other optional additives that may be beneficial in the second or other coatings that form the adherent coating include surfactants, wetting agents, antifoaming agents, colorants, coating modifiers, and coupling agents.

An anionic surfactant is beneficial to incorporate the lubricant into the second coating. An example of an effective anionic surfactant is sodium dioctyl sulfosuccinate, available as "Aerosol OT-75" from Cytec Do Brasil Ltda., Sao Paulo, SP, Brazil. Another useful emulsifier is triethanolamine, such as that available as "Triethanolamine 99% TECH" from Ashland Chemical Company, Columbus, Ohio.

A wetting agent is useful to promote impregnation of the fibrous buffing material with the coatings. Useful wetting agents include surfactants that are at least partially non-ionic, such as "NopcoWet BR", available from Gap Quimica Ltda., Guarulhos, SP, Brazil. Other useful nonionic surfactants include "TERGITOL 15-S-40" and "TERGITOL XJ", both from Dow Chemical, Midland, Mich., and "PEG DS6000" available from BASF, Florham Park, N.J.

Coating modifiers and VOC reducers such as hydroxyethyl ethylene urea are useful to promote film formation. Useful coating modifiers include "SR-511" available from Sartomer Company, Exton, Pa. Other coating modifiers and pH adjusters such as citric acid are useful to control coating viscosity.

A coupling agent is useful to improve adhesion between the nonwoven buffing material, the binder, and the abrasive mineral. Useful coupling agents include "Z-6020 Silane" and "Z-6040 Silane", both available from Dow Corning, Midland, Mich. Colorants or pigments such as iron oxide, titanium oxide, or carbon black may be added to visually identify different buffing articles and/or type of buffing article. In some embodiments, pigments such as chromium oxide may also serve as an abrasive particle. Suitable colorants pigments include "KRONOS 2310" (Kronos Inc., Houston, Tex.), "E2616 GREEN" (Akrochem Corporation, Akron, Ohio), "BK-5099 PIGMENT" (Elementis Pigments Inc., Fairview heights, Ill.), and "Copperas Red Iron Oxide R5098D" (Rockwood Pigments Inc., Beltsville, Md.)

Coating Impregnation Process

The self-contained fibrous buffing articles are made by impregnating a length of suitable fibrous nonwoven fabric with a prebond coating and then hardening the first crosslinkable binder. Prebond coatings may be applied by conventional application means, such as roll coating, curtain coating, die coating, or spraying.

Then, a second coating comprising abrasive particles, a lubricant, and optionally a second crosslinkable binder precursor and wetting agent and/or a surfactant, followed by a hardening step forming a hardened second coating on the fibers and surfaces of the nonwoven fabric. The adherent coating may be incorporated into the fibrous material in one or more steps with either one or more hardening steps as previously discussed. In some embodiments, a second coating is incorporated and hardened, followed by a subsequent coating comprising additional lubricant, followed by an additional hardening step. Adherent coatings may be applied by conventional application means, such as roll coating, curtain coating, die coating, or spraying.

In some embodiments, the total dry add-on weight of the coating(s) is from 50 $g/m^2$ to 2000 $g/m^2$, or from 200 $g/m^2$ to 1500 $g/m^2$, or from 200 $g/m^2$ to 1100 $g/m^2$. In some embodiments, the total weight of the final coated buffing fabric is from 200 $g/m^2$ to 1500 $g/m^2$.

During the hardening step(s), as water is removed, it has been discovered that more desirable adherent coating formulations separate into a hydrophilic phase and a lipophilic phase. While not wishing to be bound by theory, the inventors believe that the partitioning of the various coating constituents into these discrete phases after hardening contributes to superior buffing performance when using the self-contained fibrous buffing article.

Self-Contained Fibrous Buffing Articles

The buff must not only be capable of withstanding the strenuous use conditions typically encountered in buffing operations, but it must also be capable of holding the adherent buffing composition on the buffing surface. Self-contained fibrous buffing articles may be any design or style presently known or contemplated in the future. The most popular forms of buffs are depicted by FIGS. 1-3.

FIG. 1 shows a buff 10 composed of layers 11 of fibrous buffing material, optionally sewn with one or more circles of stitching 12 with suitable thread which is known for this purpose between the outer edge 13 and central opening 14 for attachment to a rotating spindle or mandrel. Layers of fibrous buffing material have a generally circular shape and they are stacked (or the entire assembly is cut) so that the edges of each of the layers define a cylindrical surface which is the peripheral edge of the buff.

Figure 2:
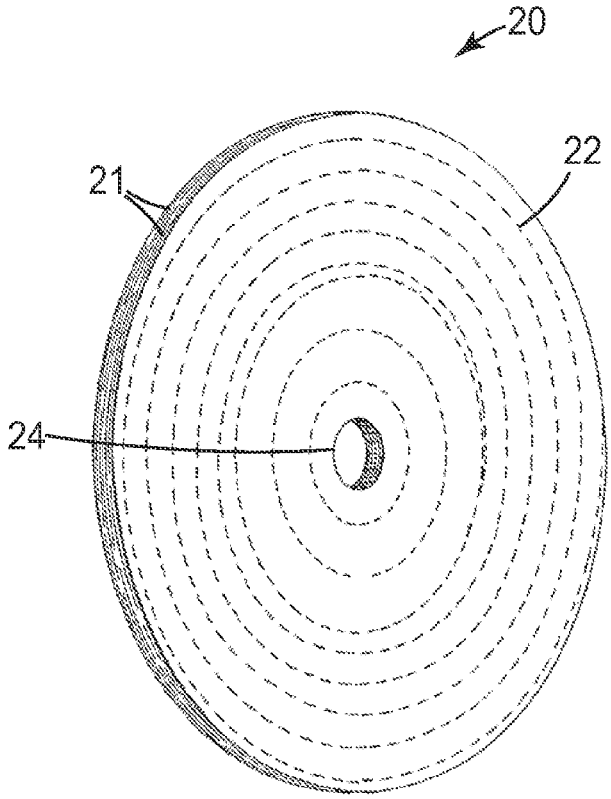
FIG. 2 illustrates a second embodiment of a self-contained fibrous buffing article

FIG. 2 shows a buff 20 composed of layers 21 of fibrous buffing material sewn together with several circular patterns 22 of stitching with suitable thread. The sewing pattern may be concentric, spiral, square, radial, radial arc, or combinations thereof. Buff 20 has a central opening 24 for attachment to a rotating spindle or mandrel.

Figure 3:
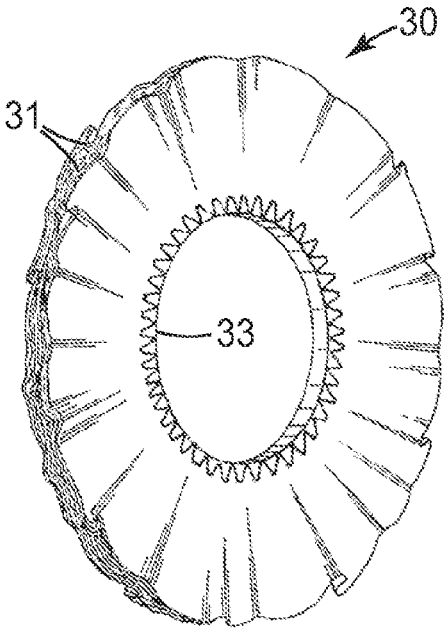
FIG. 3 illustrates a third embodiment of a self-contained fibrous buffing article

FIG. 3 depicts what is known as a "puckered" buff 30 which is produced by cutting a continuous strip of fibrous buffing material and convolutely wrapping this strip around the separated ends of axially aligned cylindrical mandrels, radially constricting the wrapped strip at its middle to form a flattened "puckered" annulus, and installing a rigid clinch ring 33 of either plastic or metal within the opening of the annulus. A "puckered" fibrous buffing material annulus may also be fastened by stapling, sewing or adhesive bonding to a suitable rigid annulus such as an annulus formed of cardboard.

The particular construction of a sewn buff will depend upon its ultimate use. Buffs formed of layers of fabric, which are sewn together, as shown in FIG. 2 are typically used for cut buffing. Very close rows of stitching increase the stiffness of the sewn buff to increase cut. The sewing patterns for such buffs may vary, depending upon the needs of the user, from concentric sewn, radial sewn, square sewn, spiral sewn, to radial arc sewn and radial arc with spiral center. Concentric sewing results in non-uniform density when the buff wears as it is used. As the buff wears closer to the stitches, the buff will become harder and just past a row of stitches it becomes softer. Spiral sewing results in a more uniform density, although the buff surface will still have a density variation. Square and non-concentric sewing patterns produce pockets that may aid in the buffing process.

The puckered or pleated buff is popular for its cool running capability, provided by pleats or puckers in its fabric. The type of the construction of a puckered buff depends upon its ultimate use also. Different hardnesses may be required for various cutting and/or color buffing applications. Hardness may be controlled somewhat by the spacing of buffs on the mandrel, but more commonly is regulated by the degree of puckering, the diameter of the buff relative to the clinch ring diameter, or the stiffness of the buff fabric.

Figure 4:
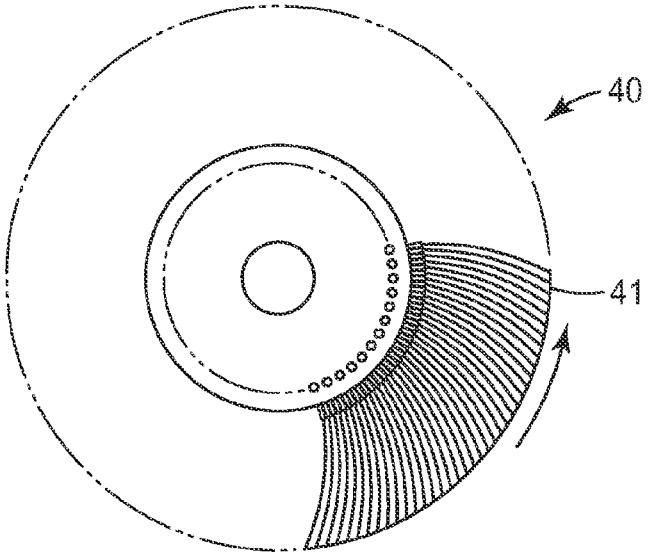
FIG. 4 illustrates a fourth embodiment of a self-contained fibrous buffing article
Figure 5:
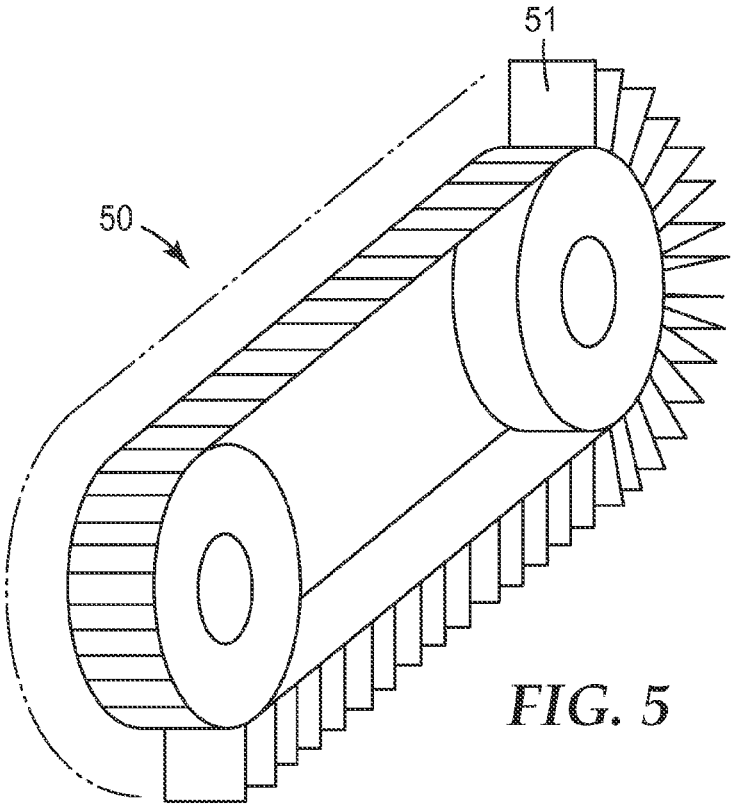
FIG. 5 illustrates a fifth embodiment of a self-contained fibrous buffing article

Other self-contained fibrous buffing articles may also find utility, including "flap wheel" constructions 40 as illustrated in FIG. 4 having individual buffing flaps 41, or "flap belt" constructions 50 as illustrated in FIG. 5 having individual buffing flaps 51. Buffing articles such as needletacked belts or discs may also find utility.

The density of the nonwoven material with the hardened adherent coating in a flat configuration before being puckered into a buff may range from 0.1 g/cm$^3$ to 0.6 g/cm$^3$, from 0.2 g/cm$^3$ to 0.5 g/cm$^3$, or from 0.3 g/cm$^3$ to 0.45 g/cm$^3$. The density of the nonwoven material with the hardened adherent coating is the weight in grams divided by the volume in cubic centimeters. Buffs having too low of a density have insufficient cut while those having too high of a density tend to smear.

As exemplified in Table 8, the nonwoven material with the hardened adherent coating forming the self-contained fibrous buffing article has particularly effective results when using stearic acid, mineral oil, and glycerin in combination as the lubricant blend. In some embodiments, the fiber portion of the nonwoven material with the hardened adherent coating comprise 10-25 wt. % (weight percent) or 15-20 wt. %. The amount of lyocell fibers, if used, in the fiber portion weight percent can vary and be 25-80 wt. %, 30-70 wt. percent, or 40-60 wt. % with the balance being other fibers such staple length polyamide fibers. Too much lyocell fiber produces too weak of a buffing article while too little results in significantly reduced buffing performance. The abrasive mineral portion of the nonwoven material with the hardened adherent coating comprises 20-60 wt. %. or 35-55 wt. %. The lubricant portion of the nonwoven material with the hardened adherent coating comprises a blend of at least stearic acid, mineral oil, and glycerin and comprises 5-45 wt. %, or 20-35 wt. %. The stearic acid can comprise 5-35 wt. %, 10-30 wt. %, or 15-25 wt. %; the glycerin can comprise 0.5 to 25 wt. %, 1-20 wt. %, or 2-6 wt. %; and the mineral oil can comprise 0.5-15 wt. %, 1-10 wt. %, or 0.5-5.5 wt. %.

EXAMPLES

Objects and advantages of this invention are further illustrated by the following non-limiting examples; however, the particular materials and amounts thereof recited in these examples, as well as other conditions and details, should not be construed to unduly limit this invention. Unless otherwise noted, all parts, percentages, ratios, etc. in the Examples and the rest of the specification are by weight. The abbreviations shown in Table 1 are used throughout the Examples.

TABLE 1

ABBREVIATION INDEX

| Abbreviation | Description |
|---|---|
| T15 | Surfactant, available from Dow, Midland, Michigan as "TERGITOL 15-S-40" |
| PEG | Surfactant, available from BASF, Florham Park, New Jersey as "MAPEG DS6000" |
| TEA | Triethanolamine, available from Ashland Chemical Company, Columbus, Ohio "Triethanolamine 99% TECH" |
| Glycerin | Polyol, obtained from Acme Hardesty Oleochemicals, Blue Bell, Pennsylvania |
| CrO | Chromium oxide abrasive, obtained from Akrochem Corporation, Akron, Ohio as "E2616 Green" |
| TiO | Kronos 2310, titanium dioxide pigment, obtained from Kronos Inc. Houston, TX |
| FeO | Black iron oxide, BK-5099 Pigment, obtained from Elementis Pigments Inc. Fairview Heights, IL |
| WCA | "MICROGRIT WCA #3", aluminum oxide powder having an average particle size of 3.25 micrometers, obtained from Micro Abrasives Corporation, Westfield, MA |
| PXA | "MICROGRIT PXA 411", unfused aluminum oxide powder having an average partical size of 0.75 micrometers, obtained from Micro Abrasives Corporation, Westfield, MA |
| CrO/TiO | Abrasive particle blend, 50.0% $Cr_2O_3$ and 50.0% $TiO_2$ by weight |
| FeO/WCA | Abrasive particle blend, 25.0 wt % $Fe_2O_3$ and 75.0 wt % WCA |
| SA | Stearic acid, obtained from PMC Biogenics, Memphis, Tennessee as "INDUSTRENE 4516" |
| LiSt | Lithium stearate lubricant, obtained from Ashland, Inc., Covington, Kentucky as "LIC17" |
| MO | Mineral oil, obtained from Univar USA, Redmond, Washington |
| BL16 | Polyurethane prepolymer, obtained from Chemtura Group, Middlebury, Connecticut as "ADIPRENE BL-16" |
| TXJ | Surfactant, available from Dow Chemical, Midland, Michigan as "TERGITOL XJ" |
| KAA | Amine curing agent, available from Nippon Kayaku Company, Ltd, Tokyo, Japan as "KAYAHARD AA" |
| SR511 | Hydroxyethyl ethylene urea, available from Sartomer Company, Inc, Exton, Pennsylvania as "SR-511 A" |
| Arofene | Phenolic resin, obtained from Ashland Inc., Covington, Kentucky as "AROFENE 72155 W55" |
| Lyocell 1.7 | Lyocell staple fiber, 1.7 dtex × 38 mm, available from Lenzing Fibers, Lenzing, Austria as "Tencel HS 260" |
| Lyocell 2.4 | Lyocell staple fiber, 2.4 dtex × 38 mm, available from Lenzing Fibers, Lenzing, Austria as "Tencel HS 260" |
| Nylon 15 | Polyamide staple fiber, nylon 6,6, "Type 501, 15 Denier 1.5 inch cut length, merge 153×90", obtained from Invista, Wichita, KS |
| Nylon 3 | Polyamide staple fiber, nylon 6,6, "Type 881, 3 Denier 2.0 inch cut length, merge 134×P7", obtained from Invista, Wichita, KS |

TABLE 1-continued

| ABBREVIATION INDEX | |
|---|---|
| Abbreviation | Description |
| W-290H | "WITCOBOND W-290H" aqueous polyurethane dispersion, obtained from Chemtura, Middlebury, Connecticut |
| GL-720 | "RHOPLEX GL-720", water based acrylic, obtained from Rhom and Haas Philadelphia PA |
| PMA | Propylene glycol monomethyl ether acetate, "DOWANOL PMA 484431", obtained from Sigma Aldrich, St. Louis, Missouri |
| K450 | Aromatic amine curing agent, "LAPOX K-450", obtained from Royce International, East Rutherford, New Jersey |

TABLE 2

| Coating Formulations for Examples 1 & 2 | | | |
|---|---|---|---|
| Material | Coating 1, % | Coatings 2 & 4, % | Coating 3, % |
| Water | 77.6 | 65.5 | 58.4 |
| T15 | 1.3 | 1.5 | 1.6 |
| PEG | 1.0 | 1.0 | 1.1 |
| TEA | 0.2 | 0.6 | 0.6 |
| Glycerin | 1.2 | 3.7 | 3.9 |
| CrO | 5.2 | 9.2 | 9.7 |
| TiO | 5.2 | 9.2 | 9.7 |
| SA | 2.4 | 7.7 | 8.1 |
| LiSt | 0.6 | 0.4 | 0.4 |
| MO | 1.1 | 1.0 | 1.1 |
| BL16 | 3.7 | 0.0 | 0.0 |
| TXJ | 0.1 | 0.0 | 0.0 |
| KAA | 0.6 | 0.0 | 0.0 |
| SR511 | 0.0 | 0.2 | 0.2 |
| Arofene | 0.0 | 0.0 | 5.0 |

TABLE 3

| Coating Formulations for Example 3 | | | | |
|---|---|---|---|---|
| Material | Coating 1, % | Coating 2, % | Coating 3, % | Coating 4, % |
| Water | 71.0 | 71.4 | 55.5 | 58.8 |
| T15 | 1.7 | 2.0 | 1.7 | 2.6 |
| PEG | 0.2 | 0.3 | 0.3 | 0.4 |
| TEA | 0.2 | 0.8 | 0.7 | 1.1 |
| Glycerin | 1.5 | 4.9 | 4.3 | 6.5 |
| FeO | 2.4 | 1.6 | 1.7 | 1.3 |
| WCA3 | 7.3 | 4.9 | 5.2 | 3.9 |
| SA | 3.2 | 10.2 | 9.0 | 13.6 |
| LiSt | 0.7 | 1.2 | 1.1 | 1.6 |
| MO | 1.4 | 2.4 | 2.2 | 3.2 |
| BL16 | 8.7 | 0.0 | 0.0 | 0.0 |
| TXJ | 0.2 | 0.0 | 0.0 | 0.0 |

TABLE 3-continued

| Coating Formulations for Example 3 | | | | |
|---|---|---|---|---|
| Material | Coating 1, % | Coating 2, % | Coating 3, % | Coating 4, % |
| KAA | 1.3 | 0.0 | 0.0 | 0.0 |
| SR511 | 0.0 | 0.3 | 0.3 | 0.4 |
| Arofene | 0.0 | 0.0 | 18.0 | 0.0 |
| W290H | 0.0 | 0.0 | 0.0 | 2.2 |
| GL720 | 0.0 | 0.0 | 0.0 | 4.3 |

TABLE 4

| Coating Formulations for Example 4 | | | |
|---|---|---|---|
| Material | Coating 1, % | Coatings 2 & 4, % | Coating 3, % |
| Water | 64.0 | 61.0 | 51.0 |
| T15 | 1.8 | 0.3 | 0.3 |
| PEG | 1.8 | 1.2 | 1.3 |
| TEA | 0.2 | 0.7 | 0.8 |
| Glycerin | 1.3 | 4.3 | 4.6 |
| CrO | 17.8 | 21.5 | 22.9 |
| SA | 2.7 | 9.0 | 9.5 |
| LiSt | 1.1 | 0.5 | 0.5 |
| MO | 1.8 | 1.2 | 1.3 |
| BL16 | 6.4 | 0.0 | 0.0 |
| TXJ | 0.2 | 0.0 | 0.0 |
| KAA | 1.0 | 0.0 | 0.0 |
| SR511 | 0.0 | 0.3 | 0.3 |
| Arofene | 0.0 | 0.0 | 7.6 |

TABLE 5

| Coating Formulations for Examples 5-7 | | | |
|---|---|---|---|
| Material | Coating 5, % | Coating 6, % | Coating 7, % |
| Water | 0.0 | 51.1% | 55.3% |
| T15 | 0.0 | 0.4% | 0.5% |
| TEA | 0.0 | 0.3% | 0.3% |
| Glycerin | 0.0 | 4.8% | 5.2% |
| SR511 | 0.0 | 0.3% | 0.3% |
| MO | 0.0 | 1.4% | 1.5% |
| LiSt | 0.0 | 0.5% | 0.6% |
| PEG | 0.0 | 0.6% | 0.6% |
| PXA | 0.0 | 21.5% | 23.3% |
| CrO | 0.0 | 0.9% | 1.0% |
| SA | 0.0 | 10.5% | 11.4% |
| Arofene | 0.0 | 7.6% | 0.0 |
| PMA | 58.2 | 0.0 | 0.0 |
| BL16 | 35.0 | 0.0 | 0.0 |
| K450 | 5.4 | 0.0 | 0.0 |
| LiSt | 1.4 | 0.0 | 0.0 |

TABLE 6

| Coating Formulations for Examples 8-12 | | | | | | | | | | |
|---|---|---|---|---|---|---|---|---|---|---|
| | Coating 8, % | Coating 9, % | Coating 10, % | Coating 11, % | Coating 12, % | Coating 13, % | Coating 14, % | Coating 15, % | Coating 16, % | Coating 17, % |
| Water | 51.0% | 55.2% | 51.0% | 55.2% | 51.0% | 55.2% | 51.0% | 55.2% | 51.0% | 55.2% |
| T15 | 0.4% | 0.5% | 0.4% | 0.5% | 0.4% | 0.5% | 0.4% | 0.5% | 0.4% | 0.5% |
| TEA | 0.4% | 0.5% | 0.4% | 0.5% | 0.4% | 0.5% | 0.4% | 0.5% | 0.4% | 0.5% |
| Glycerin | 4.8% | 5.2% | 0.8% | 0.9% | 4.8% | 5.2% | 8.8% | 9.5% | 0.8% | 0.9% |
| SR511 | 0.3% | 0.3% | 0.3% | 0.3% | 0.3% | 0.3% | 0.3% | 0.3% | 0.3% | 0.3% |
| MO | 1.4% | 1.5% | 5.3% | 5.8% | 5.3% | 5.8% | 1.4% | 1.5% | 1.4% | 1.5% |
| LiSt | 0.5% | 0.6% | 0.5% | 0.6% | 0.5% | 0.6% | 0.5% | 0.6% | 0.5% | 0.6% |
| PEG | 0.7% | 0.7% | 0.7% | 0.7% | 0.7% | 0.7% | 0.7% | 0.7% | 0.7% | 0.7% |
| PXA | 21.5% | 23.2% | 21.5% | 23.2% | 21.5% | 23.2% | 21.5% | 23.2% | 21.5% | 23.2% |
| CrO | 0.9% | 1.0% | 0.9% | 1.0% | 0.9% | 1.0% | 0.9% | 1.0% | 0.9% | 1.0% |

TABLE 6-continued

| Coating Formulations for Examples 8-12 | | | | | | | | | | |
|---|---|---|---|---|---|---|---|---|---|---|
| | Coating 8, % | Coating 9, % | Coating 10, % | Coating 11, % | Coating 12, % | Coating 13, % | Coating 14, % | Coating 15, % | Coating 16, % | Coating 17, % |
| SA | 10.5% | 11.4% | 10.5% | 11.4% | 6.5% | 7.1% | 6.5% | 7.1% | 14.5% | 15.7% |
| Arofene | 7.6% | 0.0% | 7.6% | 0.0% | 7.6% | 0.0% | 7.6% | 0.0% | 7.6% | 0.0% |

TABLE 7

| Coating Formulations or Examples 13-15 | | | |
|---|---|---|---|
| Material | Coating 18, % | Coating 19, % | Coating 20, % |
| Water | 54.8% | 54.9% | 54.9% |
| T15 | 0.6% | 0.5% | 0.4% |
| TEA | 0.3% | 0.3% | 0.2% |
| Glycerin | 2.8% | 2.3% | 1.9% |
| SR511 | 0.0% | 0.0% | 0.0% |
| MO | 1.9% | 1.5% | 1.3% |
| LiSt | 0.0% | 0.0% | 0.0% |
| PEG | 0.7% | 0.5% | 0.5% |
| PXA | 24.0% | 27.8% | 30.4% |
| CrO | 1.0% | 0.8% | 0.7% |
| SA | 14.0% | 11.4% | 9.7% |

mm thick fabric. Coating 1 (coatings are described in Table 2) was applied (all coatings were applied via a roll coater) to a wet add-on of 301 g/m$^2$ and heated 5 minutes at 160 degrees C. Coating 2 was then applied to a wet add-on of 399 g/m$^2$ and heated 5 minutes at 140 degrees C. Coating 3 was then applied to achieve a wet add-on of 491 g/m$^2$ and heated 5 minutes at 176 degrees C. Finally, Coating 4 was applied to a wet add-on of 465 g/m$^2$ and heated 5 minutes at 140 degrees C.

The cumulative dry coated fabric weight was 386 g/m$^2$ and the final thickness varied between 2.8 and 3.5 mm. The coated fabric was then converted into 10 inch diameter discs by die cutting and the resulting discs were evaluated using the Buffing Test.

TABLE 8

| Component Wt. Percentages of Nonwoven with Hardened Adherent Coating Examples 5-15 | | | | | | | | | | | |
|---|---|---|---|---|---|---|---|---|---|---|---|
| | Example 5 | Example 6 | Example 7 | Example 8 | Example 9 | Example 10 | Example 11 | Example 12 | Example 13 | Example 14 | Example 15 |
| Fiber | 14.4% | 17.7% | 20.3% | 18.9% | 18.9% | 21.2% | 19.9% | 16.7% | 16.9% | 17.3% | 18.2% |
| Prebond Binder | 3.0% | 3.7% | 4.3% | 4.0% | 4.0% | 4.4% | 4.2% | 3.5% | 3.5% | 3.6% | 3.8% |
| T15 | 0.6% | 0.6% | 0.5% | 0.5% | 0.5% | 0.5% | 0.5% | 0.6% | 0.7% | 0.6% | 0.5% |
| TEA | 0.6% | 0.6% | 0.5% | 0.7% | 0.7% | 0.7% | 0.7% | 0.8% | 0.6% | 0.5% | 0.4% |
| Glycerin | 9.1% | 8.6% | 8.2% | 8.4% | 1.4% | 8.1% | 15.1% | 1.5% | 4.9% | 4.0% | 3.4% |
| SR511 | 0.6% | 0.6% | 0.5% | 0.5% | 0.5% | 0.5% | 0.5% | 0.6% | 0.0% | 0.0% | 0.0% |
| MO | 2.6% | 2.4% | 2.3% | 2.4% | 9.4% | 9.0% | 2.3% | 2.5% | 3.3% | 2.7% | 2.2% |
| LiSt | 1.1% | 1.1% | 1.0% | 1.0% | 1.0% | 1.0% | 1.0% | 1.1% | 0.1% | 0.1% | 0.1% |
| PEG | 1.1% | 1.1% | 1.0% | 1.2% | 1.2% | 1.1% | 1.2% | 1.2% | 1.2% | 0.9% | 0.8% |
| PXA | 41.0% | 38.5% | 36.9% | 37.6% | 37.7% | 36.3% | 37.0% | 39.1% | 42.4% | 48.8% | 52.7% |
| CrO | 1.7% | 1.6% | 1.6% | 1.6% | 1.6% | 1.5% | 1.6% | 1.7% | 1.8% | 1.4% | 1.2% |
| SA | 20.1% | 18.9% | 18.1% | 18.4% | 18.4% | 11.1% | 11.3% | 26.4% | 24.7% | 20.0% | 16.7% |
| Arofene | 4.1% | 4.7% | 4.6% | 4.8% | 4.6% | 4.5% | 4.6% | 4.5% | 0.0% | 0.0% | 0.0% |
| Fiber | 14.4% | 17.7% | 20.3% | 18.9% | 18.9% | 21.2% | 19.9% | 16.7% | 16.9% | 17.3% | 18.2% |
| Prebond Resin | 3.0% | 3.7% | 4.3% | 4.0% | 4.0% | 4.4% | 4.2% | 3.5% | 3.5% | 3.6% | 3.8% |
| Lubricant (SA, MO, Glycerin, LiSt) | 32.9% | 30.9% | 29.7% | 30.2% | 30.3% | 29.2% | 29.7% | 31.4% | 33.0% | 26.8% | 22.4% |
| Other (T15, TEA, SR511, PEG, Arofene) | 7.0% | 7.5% | 7.2% | 7.8% | 7.6% | 7.4% | 7.6% | 7.6% | 2.5% | 2.0% | 1.7% |
| Mineral (PXA, CrO) | 42.7% | 40.1% | 38.5% | 39.2% | 39.3% | 37.8% | 38.6% | 40.8% | 44.1% | 50.2% | 53.9% |

Examples 1-15

Examples 1-15 were prepared to demonstrate various embodiments of the self-contained fibrous buffing article.

Example 1

The self-contained fibrous buffing article of Example 1 was prepared to compare its ability to refine a metallic surface to that of current buffing articles. A 130 g/m$^2$ airlaid nonwoven fabric was prepared from 100% Lyocell 1.7 fibers (see materials description in Table 1) and needletacked to produce a 4.5

Example 2

Example 2 was prepared identically to Example 1 except that a 167 g/m$^2$ fabric of 75/25 wt % blend of lyocell 1.7/nylon 15 staple fiber was substituted for 100% lyocell 1.7 staple fiber and the final weight was 473 g/m$^2$.

Example 3

Example 3 was prepared identically to Example 1 except that a 280 g/m$^2$ fabric of 90/10 wt % blend of lyocell 1.7/nylon 15 staple fiber was substituted for the 130 g/m$^2$ fabric of 100% lyocell 1.7 staple fiber, the abrasive particles in the coatings were FeO/WCA instead of CrO/TiO, the coatings were those indicated in Table 3, and the final weight was 900 g/m$^2$.

Example 4

Example 4 was prepared identically to Example 1 except that a 285 g/m$^2$ fabric of 90/10 wt % blend of lyocell 1.7/nylon 15 staple fiber was substituted for the 130 g/m$^2$ fabric of 100% lyocell 1.7 staple fiber, the abrasive particles in the coatings were CrO instead of CrO/TiO, the coatings were those indicated in Table 4 and the final weight was 826 g/m$^2$.

Example 5

A 193 g/m$^2$ airlaid nonwoven fabric of 50 wt % lyocell 2.4 staple fiber and 50 wt % nylon 3 staple fiber was prepared and needletacked to produce an approximately 3.2 mm (0.125 in) thick fabric. Approximately 42 g/m$^2$ dry weight of Coating 5 found in Table 5 was applied via a roll coater and dryed in a tunnel oven at 163 degrees C. for 6 minutes to form the prebonded fibrous nonwoven fabric. Coating 6 found in Table 5 was applied via a roll coater at approximately 581 g/m$^2$ dry weight and dried in a tunnel oven at 121 degrees C. for 12 minutes. Finally, Coating 7 found in Table 5 was applied via a roll coater at approximately 514 g/m$^2$ dry weight and dried in a tunnel oven at 121 degrees C. for 6 minutes.

The cumulative dry coated fabric weight was 1330 g/m$^2$ with a final thickness of approximately 3.2 mm (0.125"). The final density of Example 5 was calculated to be approximately 0.45 g/cm$^3$. The coated fabric was converted into 203 mm (8 in) discs by die cutting and the resulting discs were evaluated using the Cut and Transfer Test.

Example 6

Coating 6 was applied via a roll coater to the prebonded fibrous nonwoven fabric of Example 5 at approximately 548 g/m$^2$ dry weight and dried in a tunnel oven at 121 degrees C. for 6 minutes. Coating 7 was applied via a roll coater at approximately 293 g/m$^2$ dry weight and dried in a tunnel oven at 121 degrees C. for 6 minutes.

The final density of Example 6 was calculated to be approximately 0.36 g/cm$^3$. The coated fabric was converted into 203 mm (8 in) discs by die cutting and the resulting discs were evaluated using the Cut and Transfer Test.

Example 7

Coating 6 was applied via a roll coater to the prebonded fibrous nonwoven fabric of Example 5 at approximately 460 g/m$^2$ dry weight and dried in a tunnel oven at 121 degrees C. for 6 minutes. Coating 7 was applied via a roll coater at approximately 243 g/m$^2$ dry weight and dried in a tunnel oven at 121 degrees C. for 6 minutes.

The final density of Example 7 was calculated to be approximately 0.30 g/cm$^3$. The coated fabric was converted into 203 mm (8 in) discs by die cutting and the resulting discs were evaluated using the Cut and Transfer Test.

Example 8

Coating 8 was applied via a roll coater to the prebonded fibrous nonwoven fabric of Example 5 at approximately 515 g/m$^2$ dry weight and dried in a tunnel oven at 121 degrees C. for 12 minutes. Coating 9 was applied via a roll coater at approximately 255 g/m$^2$ dry weight and dried in a tunnel oven at 121 degrees C. for 6 minutes.

The final density of Example 8 was calculated to be approximately 0.34 g/cm$^3$. The coated fabric was converted into 203 mm (8 in) discs by die cutting and the resulting discs were evaluated using the Cut and Transfer Test.

Example 9

Coating 10 was applied via a roll coater to the prebonded fibrous nonwoven fabric of Example 5 at approximately 502 g/m$^2$ dry weight and dried in a tunnel oven at 121 degrees C. for 12 minutes. Coating 11 was applied via a roll coater at approximately 272 g/m$^2$ dry weight and dried in a tunnel oven at 121 degrees C. for 6 minutes.

The final density of Example 9 was calculated to be approximately 0.34 g/cm$^3$. The coated fabric was converted into 203 mm (8 in) discs by die cutting and the resulting discs were evaluated using the Cut and Transfer Test.

Example 10

Coating 12 was applied via a roll coater to the prebonded fibrous nonwoven fabric of Example 5 at approximately 431 g/m$^2$ dry weight and dried in a tunnel oven at 121 degrees C. for 12 minutes. Coating 13 was applied via a roll coater at approximately 234 g/m$^2$ dry weight and dried in a tunnel oven at 121 degrees C. for 6 minutes.

The final density of Example 10 was calculated to be approximately 0.34 g/cm$^3$. The coated fabric was converted into 203 mm (8 in) discs by die cutting and the resulting discs were evaluated using the Cut and Transfer Test.

Example 11

Coating 14 was applied via a roll coater to the prebonded fibrous nonwoven fabric of Example 5 at approximately 477 g/m$^2$ dry weight and dried in a tunnel oven at 121 degrees C. for 12 minutes. Coating 15 was applied via a roll coater at approximately 243 g/m$^2$ dry weight and dried in a tunnel oven at 121 degrees C. for 6 minutes.

The final density of Example 11 was calculated to be approximately 0.36 g/cm$^3$. The coated fabric was converted into 203 mm (8 in) discs by die cutting and the resulting discs were evaluated using the Cut and Transfer Test.

Example 12

Coating 16 was applied via a roll coater to the prebonded fibrous nonwoven fabric of Example 5 at approximately 548 g/m$^2$ dry weight and dried in a tunnel oven at 121 degrees C. for 12 minutes. Coating 17 was applied via a roll coater at approximately 356 g/m$^2$ dry weight and dried in a tunnel oven at 121 degrees C. for 6 minutes.

The final density of Example 12 was calculated to be approximately 0.36 g/cm$^3$. The coated fabric was converted into 203 mm (8 in) discs by die cutting and the resulting discs were evaluated using the Cut and Transfer Test.

Example 13

Coating 18 was applied via a roll coater to the prebonded fibrous nonwoven fabric of Example 5 at approximately 389 g/m$^2$ dry weight and dried in a tunnel oven at 121 degrees C. for 12 minutes. Coating 18 was re-applied via a roll coater at approximately 519 g/m$^2$ dry weight and dried in a tunnel oven at 121 degrees C. for 6 minutes.

The final density of Example 13 was calculated to be 0.36 g/cm$^3$. The coated fabric was converted into 203 mm (8 in) discs by die cutting and the resulting discs were evaluated using the Cut and Transfer Test.

Example 14

Coating 19 was applied via a roll coater to the prebonded fibrous nonwoven fabric of Example 5 at approximately 406 g/m$^2$ dry weight and dried in a tunnel oven at 121 degrees C. for 6 minutes. Coating 19 was re-applied via a roll coater at approximately 472 g/m$^2$ dry weight and dried in a tunnel oven at 121 degrees C. for 6 minutes.

The final density of Example 14 was calculated to be 0.35 g/cm3. The coated fabric was converted into 203 mm (8 in) discs by die cutting and the resulting discs were evaluated using the Cut and Transfer Test.

Example 15

Coating 20 was applied via a roll coater to the prebonded fibrous nonwoven fabric of Example 5 at approximately 389 g/m$^2$ dry weight and dried in a tunnel oven at 121 degrees C. for 6 minutes. Coating 20 was re-applied via a roll coater at approximately 435 g/m$^2$ dry weight and dried in a tunnel oven at 121 degrees C. for 6 minutes.

The final density of Example 15 was calculated to be 0.33 g/cm$^3$. The coated fabric was converted into 203 mm (8 in) discs by die cutting and the resulting discs were evaluated using the Cut and Transfer Test.

Example 16

Cleaning Buff

The nonwoven fabric comprising lyocell fiber was prepared and incorporated into a cleaning buff construction having neither abrasive particles nor lubricant added to the nonwoven fabric.

A 193 g/m$^2$ airlaid nonwoven fabric of 50 wt. % lyocell 2.4 staple fiber and 50 wt. % nylon 3 staple fiber was prepared and needletacked to produce an approximately 3.2 mm (0.125 in) thick fabric. Approximately 42 g/m$^2$ dry weight of Coating 5 found in Table 5 was applied via a roll coater and dried in a tunnel oven at 163 degrees C. for 6 minutes to form the prebonded fibrous nonwoven fabric having a dry weight of 235 g/m$^2$ and a final thickness of approximately 3.1 mm. The final density of Example 16 was calculated to be approximately 0.19 g/cm$^3$. The prebonded fibrous nonwoven fabric was converted into 203 mm (8 in) discs by die cutting and the resulting discs were evaluated in an off-hand operation. Knee implants were first manually treated with a buff constructed from the material of Example 13 and subsequently cleaned with a buff constructed from the nonwoven fabric of Example 16. The haze and residual film left on the implant was easily removed by nonwoven fabric discs of Example 16 exposing the high gloss finish on the knee implant.

Comparative Examples A through D

Comparative Examples A through D were commercially available buffing articles, all of which required the use of an external buffing compound. A preliminary evaluation of seven commercially available buffing compounds was made. The top-performing three for each type of metal were chosen for the comparative examples.

Comparative Example A was an 80-ply spiral-sewn cotton wheel (part number SSCW1080, obtained from Caswell Electroplating, Lyons, N.Y.). Comparative Example A was used with a white rouge bar compound (White Rouge WBC5, obtained from Caswell Electroplating, Lyons, N.Y.).

Comparative Example B was a 40-ply loose cotton wheel (part number LCW1020 from Caswell Electroplating, Lyons, N.Y.). Comparative Example B was used with a jeweler's rouge buffing compound (Red Rouge JRBC5, obtained from Caswell Electroplating, Lyons, N.Y.).

Comparative Example C was identical to Comparative Example B, except that a green rouge bar buffing compound (Green Rouge SSBC5, obtained from Caswell Electroplating, Lyons, N.Y.) was substituted for the jeweler's rouge.

Comparative Example D was identical to Comparative Example B, except that a blue rouge buffing compound (Blue Rouge BLUBC5, obtained from Caswell Electroplating, Lyons, N.Y.) was substituted for the jeweler's rouge.

Test Methods

Buffing Test

The Buffing Test measured the efficacy of self-contained fibrous buffing articles and comparative buffing articles to modify the gloss of metallic substrates. Buffing efficacy was determined by the change in light reflectance as measured by a micro gloss meter (model AG-4446, obtained from Byk-Gardner USA, Columbia, Md.).

The work pieces were 12 inch×12 inch (30.5 cm×30.5 cm) sheets of 16 gauge 304 stainless steel, ⅛ inch (3.175 mm) thick 6061 aluminum, and 1/16 inch (1.5875 mm) thick brass alloy 353. Self-contained fibrous buffing articles were prepared for testing by stacking 12 discs of each Example and providing an arbor hole for mounting. Buffing articles of the Comparative Examples were tested as received. All buffing articles were 10 inches (25.4 cm) in diameter.

Buffing articles to be tested were mounted on an electric rotary tool that was disposed over an X-Y table. A stainless steel, aluminum, or brass work piece was secured to the X-Y table. Then the table was set to traverse a 9-inch (23 cm) path at 5.6 inches/sec (14.2 cm/sec) forward in the +X direction and back the same distance and at the same speed in the −X direction, in a back and forth movement for 24 times all together (24 passes), then move 0.25 inch (6.35 mm) in the +Y direction, then traverse a 9-inch (23 cm) path at 5.6 inches/sec (14.2 cm/sec) forward in the +X direction and back the same distance and at the same speed in the −X direction, in a back and forth movement for 16 times (16 passes) all together, then move 0.25 inch (6.35 mm) in the +Y direction, then traverse a 9-inch (23 cm) path at 5.6 inches/sec (14.2 cm/sec) forward in the +X direction and back the same distance and at the same speed in the −X direction, in a back and forth movement for 8 times (8 passes) all together, then move 0.25 inch (6.35 mm) in the +Y direction, then traverse a 9-inch (23 cm) path at 0.6 inches/sec (14.2 cm/sec) forward in the +X direction and back the same distance and at the same speed in the −X direction, in a back and forth movement for 4 times (4 passes) all together, then move 0.25 inch (6.35 mm) in the +Y direction, then traverse a 9-inch (23 cm) path at 5.6 inches/sec (14.2 cm/sec) forward in the +X direction and back the same distance and at the same speed in the −X direction, in a back and forth movement for 2 times (2 passes) all together. This combination of motions defined one test cycle. The rotary tool was activated to rotate at 2200 rpm under no load. The buffing article was then urged radially against the work piece at 0.5 psi (3.45 kPa) with its axis of rotation parallel to the X direction and the X-Y table was activated to move through the prescribed path.

Figure 6:
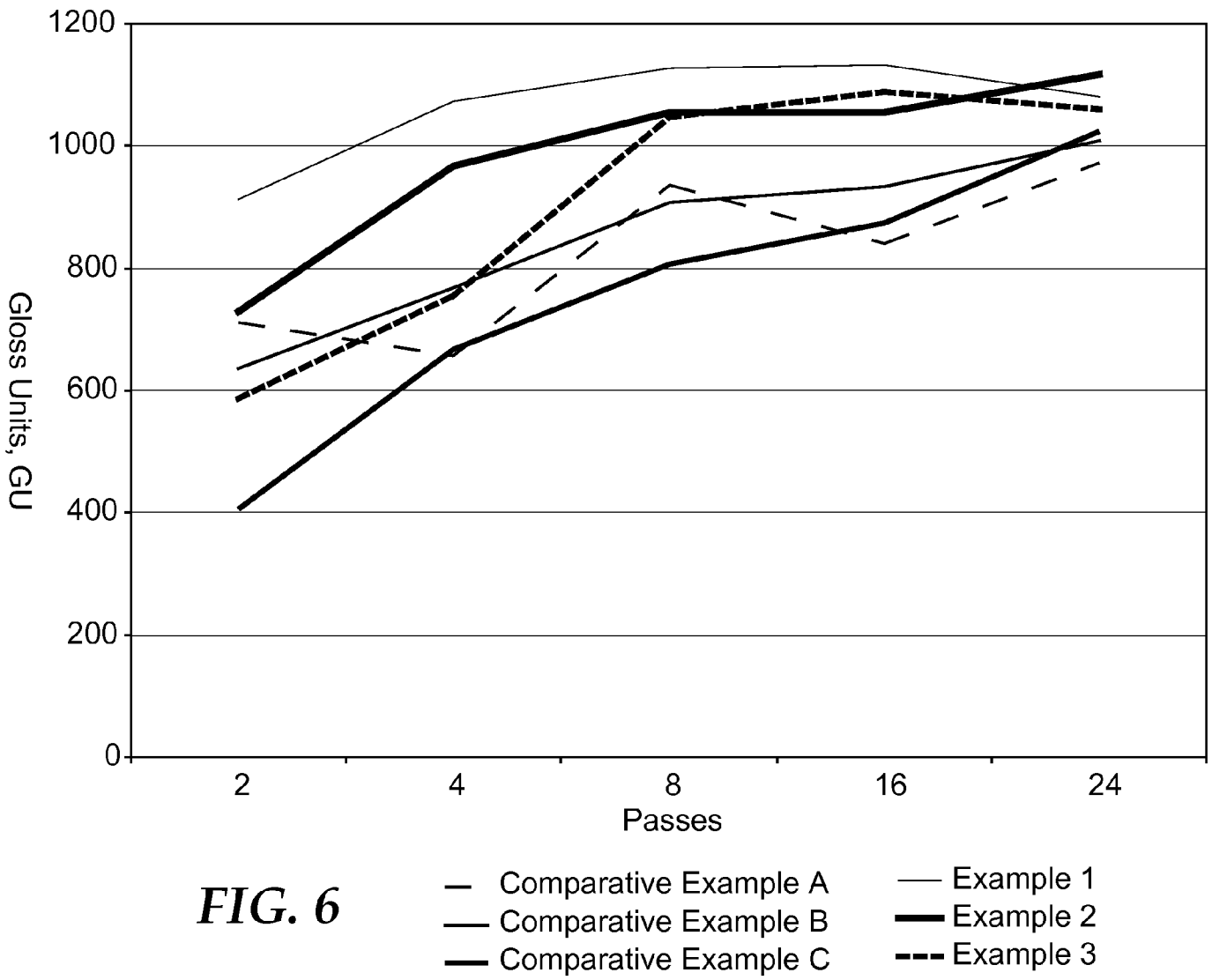
FIG. 6 illustrates comparative testing results on a stainless steel work piece
Figure 7:
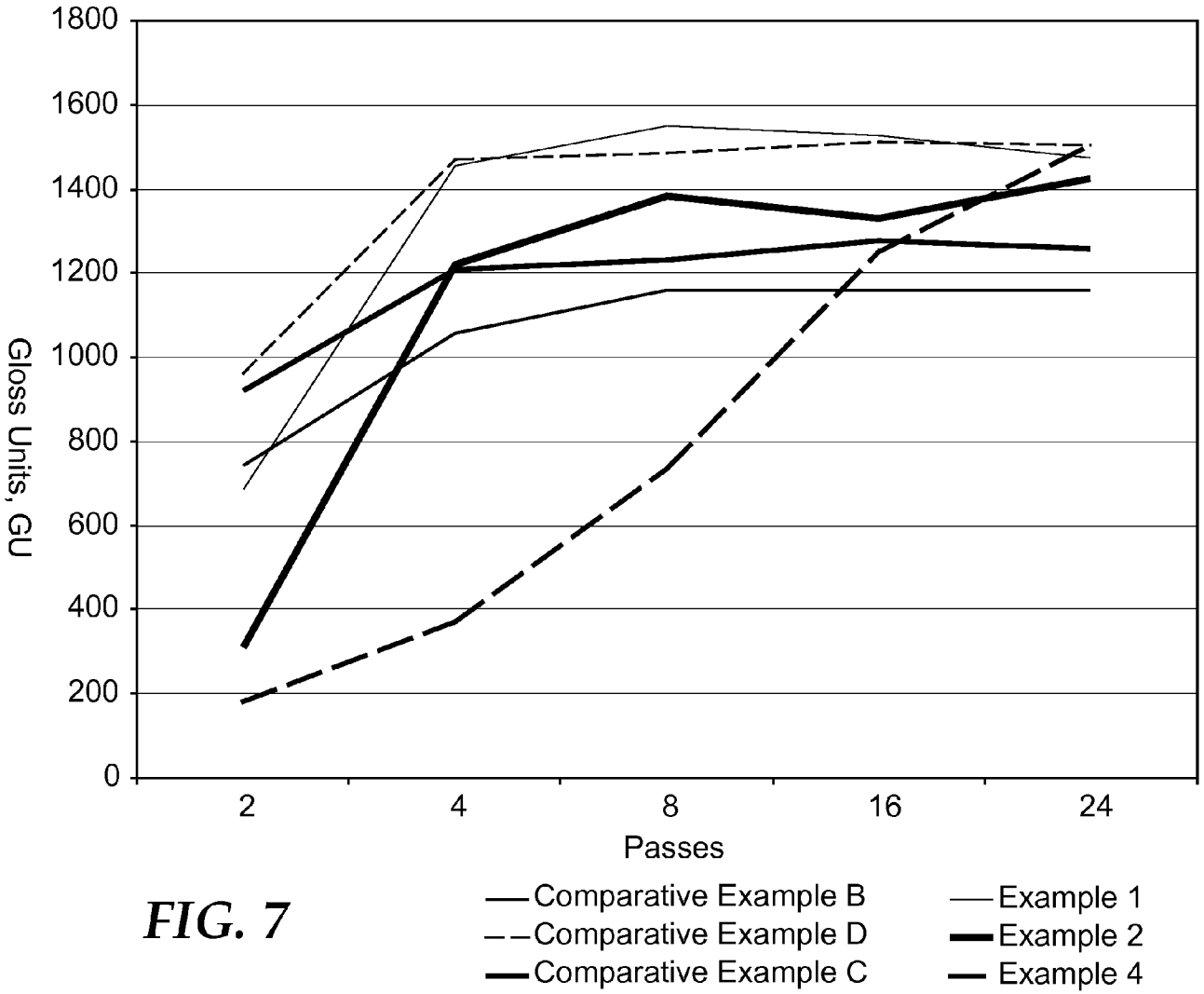
FIG. 7 illustrates comparative testing results on an aluminum work piece
Figure 8:
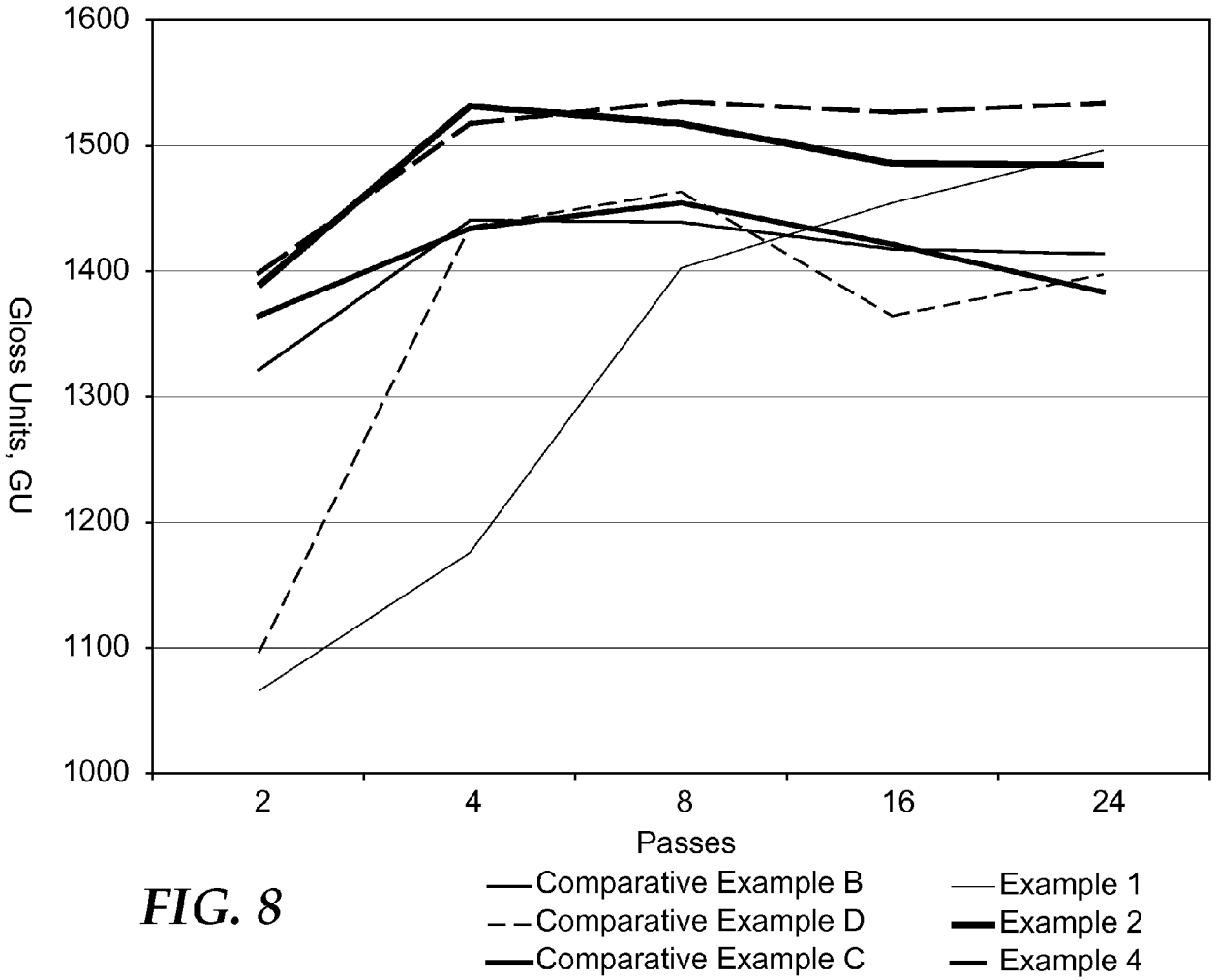
FIG. 8 illustrates comparative testing results on a brass work piece

Each buffing article was tested for 2, 4, 8, 16 and 24 cycles. A 20-degree gloss was measured after 2, 4, 8, 16, and 24 cycles. The 20-degree gloss after 24 test cycles for inventive and comparative articles is shown in Table 9. Incremental gloss change after 2, 4, 8, 16, and 24 cycles for inventive and comparative articles is shown in FIGS. 6 through 8. FIG. 6 shows the test results on a stainless steel work piece. FIG. 7 shows the test results on an aluminum work piece. FIG. 8 shows the test results on a brass work piece. In every case, the buffing articles of the invention have the same or higher gloss values than the comparative buffing articles used with externally applied buffing compounds. This is a surprising result since it was previously not possible to have a pre-impregnated buff perform the same or better as a cotton buff with externally applied buffing compound. The self-contained fibrous buffing articles frequently achieved the desired gloss level at fewer passes than the comparative buffing articles.

TABLE 9

GLOSS RESULTS

| | Gloss units | | |
|---|---|---|---|
| Example | Stainless Steel | Aluminum | Brass |
| 1 | 1082 | 1474 | 1496 |
| 2 | 1116 | 1424 | 1485 |
| 3 | 1061 | n.d.[1] | n.d.[1] |
| 4 | n.d.[1] | 1505 | 1534 |
| Comp. A | 973 | n.d.[1] | n.d.[1] |
| Comp. B | 1007 | 1158 | 1414 |
| Comp. C | 1024 | 1257 | 1384 |
| Comp D | n.d.[1] | 1504 | 1397 |

[1]n.d. = not determined

Cut and Transfer Test:

Four pre-weighed 203 mm (8 in) circular discs having a center hole of 31.75 mm (1.25 in) and a thickness of 3.2 mm (0.125 in) of the self-contained buffing material were mounted on an arbor between two 89 mm (3.5 in) flanges with three raised projections equally spaced around the flange periphery approximately 19 mm (0.75 in) in width and 16 mm deep (0.63 in) extending 9.5 mm (0.375 in) from the flange face. The projections on opposite flanges were spaced such that upon tightening of the arbor nut caused the discs to flute in an oscillating pattern around the disc periphery. The mechanically driven, variable speed lathe was adjusted to have the revolutions per minute of the arbor adjusted to generate a test speed of 1829 surface meters per minute (6000 surface feet per minute) at the outer edge of the discs. A 304 stainless steel coupon approximately 127 mm (4 in) wide× 280 mm (11 in) long×1.5 mm (0.06 in) thick was prefinished with a random orbital disc sander and 100 grit aluminum oxide coated abrasive. The 304 stainless steel, pre-weighed test coupon was mounted in a test carriage and brought horizontally against the rotating discs such that the discs contacted the test specimen at a force of 31 Newtons (7 $lb_f$). The carriage was oscillated tangentially up and down with a stroke length of 152 mm (6 in) and a stroke speed of 76 mm/sec (3 in/sec). Contact between the rotating discs and test coupon was maintained for 10 seconds, after which time contact was removed for 10 seconds. This sequence was repeated 10 times during a test sequence and the sequence was repeated four times. After the fourth sequence the test coupon was weighed upon removal, cleaned with solvent and weighed again. The difference between the initial weight prior to the test and cleaned weight was recorded as cut and the difference between the weight after testing and cleaned weight was recorded as material transfer. A 20-degree gloss was measured after the 4 cycles.

Figure 9:
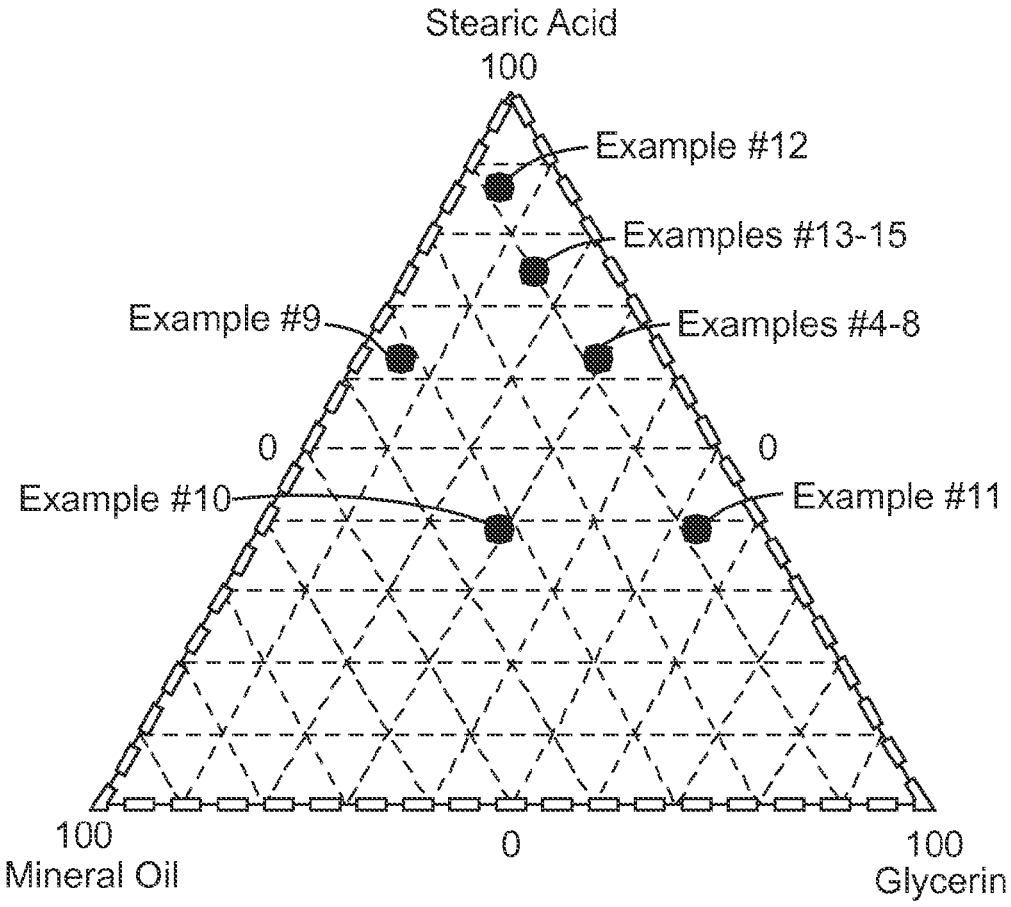
FIG. 9 illustrates the stearic acid, mineral oil, and glycerin amounts for various examples Repeated use of reference characters in the specification and drawings is intended to represent the same or analogous features or elements of the disclosure.

Table 10 shows the results of the Cut and Transfer test along with the percentages of stearic acid, glycerin and mineral oil as a total of the three ingredients and the buffing material density. The % stearic acid is calculated by dividing the % stearic acid in the mix shown in Tables 5-7 divided by the sum of the percentages for the stearic acid, glycerin and mineral oil. The % glycerin and % mineral oil are calculated in a similar manner. This allows an analysis of the three part mixture on performance. Location of the points on a triangular design plot is shown in FIG. 9. Examples 5-8 demonstrate the minimal effect of product density on cut and transfer maintaining consistent levels of stearic acid, glycerin, mineral oil, and abrasive (PXA & CrO). Examples 9-12 demonstrate the effect of stearic acid, glycerin and mineral oil on cut and transfer. As the amount of stearic acid and mineral oil are increased the cut and transfer are both significantly increased. As the amount of stearic acid is decreased and high levels of mineral oil are maintained the cut drops while the transfer continues to increase. At high amounts of stearic acid and moderate levels of mineral oil cut levels remain reasonably high and transfer to the part is reduced. Examples 12-14 demonstrate the effect of increasing the % mineral in the mixture (Table 7) resulting in a surprising decrease in cut performance and overall reduction in transfer. Coupling these two findings together provide the unexpected result of a self-contained fibrous buff with high cut levels, low levels of transfer to the work piece, and 20° gloss measurements similar to those in Table 9.

TABLE 10

Cut And Transfer Results

| | Cut (g) | Transfer (g) | 20 - Degree Gloss | % Stearic Acid | % Glycerin | % Mineral Oil | Density g/cm$^3$ |
|---|---|---|---|---|---|---|---|
| Example 4 | 0.94 | 0.52 | 979 | 63* | 29* | 8* | 0.38 |
| Example 5 | 0.49 | 0.16 | NA | 63 | 29 | 8 | 0.45 |
| Example 6 | 0.59 | 0.21 | NA | 63 | 29 | 8 | 0.36 |
| Example 7 | 0.75 | 0.29 | NA | 63 | 29 | 8 | 0.30 |
| Example 8 | 0.53 | 0.19 | NA | 63 | 29 | 8 | 0.34 |
| Example 9 | 1.25 | 0.54 | NA | 63 | 5 | 32 | 0.34 |
| Example 10 | 0.78 | 0.75 | NA | 39 | 29 | 32 | 0.36 |
| Example 11 | 0.34 | 0.39 | NA | 39 | 53 | 8 | 0.36 |
| Example 12 | 0.93 | 0.11 | NA | 87 | 5 | 8 | 0.36 |
| Example 13 | 1.46 | 0.29 | 963 | 75 | 15 | 10 | 0.36 |
| Example 14 | 0.87 | 0.04 | 1053 | 75 | 15 | 10 | 0.35 |
| Example 15 | 0.6 | 0.01 | 1097 | 75 | 15 | 10 | 0.33 |

*for Coatings 2-4

Other modifications and variations to the present disclosure may be practiced by those of ordinary skill in the art, without departing from the spirit and scope of the present disclosure, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A self-contained fibrous buffing article comprising at least one layer of a fibrous nonwoven fabric comprising lyocell fiber; the nonwoven fabric having a hardened adherent coating comprising a first coating and a second coating;

wherein the first coating comprises a crosslinked binder;

wherein the second coating is disposed on the first coating and comprises abrasive particles and a lubricant blend;

and further wherein the lubricant blend comprises at least a fatty acid, mineral oil and glycerin.

2. The self-contained fibrous buffing article of claim 1 wherein the fatty acid comprises stearic acid.

3. The self-contained fibrous buffing article of claim 1 wherein a weight percent of the fibers is 10-25 wt. %, a weight percent of the abrasive particles is 20-60 wt. %, and a weight percent of the lubricant blend is 5-45 wt. %.

4. The self-contained fibrous buffing article of claim 1, wherein the lyocell fibers comprise 25-80 wt. % of a weight percent of the fibers.

5. The self-contained fibrous buffing article of claim 4 wherein the lyocell fibers comprise 40-60 wt. % of the weight percent of the fibers.

6. The self-contained fibrous buffing article of claim 1, wherein the fatty acid comprises stearic acid and a weight percent of the stearic acid is 5-35 wt. percent.

7. The self-contained fibrous buffing article of claim 1, wherein a density of the nonwoven fabric with the hardened adherent coating comprises from 0.1 $g/cm^3$ to 0.6 $g/cm^3$.

8. The self-contained fibrous buffing article of claim 1, wherein a density of the nonwoven fabric with the hardened adherent coating comprises from 0.3 $g/cm^3$ to 0.45 $g/cm^3$.

9. The self-contained fibrous buffing article of claim 1 wherein the second coating comprises an aqueous dispersion of the abrasive particles and the lubricant blend.

10. The self-contained fibrous buffing article of claim 1 wherein the second coating comprises a crosslinked binder.

11. The self-contained fibrous buffing article of claim 1 wherein the fibrous buffing article comprises a plurality of layers of fibrous nonwoven fabric sewn together.

12. A self-contained fibrous buffing article comprising at least one layer of a fibrous nonwoven fabric comprising a majority of fibers 15 denier or less in size;

the nonwoven fabric having a hardened adherent coating comprising a first coating and a second coating;

wherein the first coating comprises a crosslinked binder;

wherein the second coating comprises abrasive particles and a lubricant blend;

and further wherein the lubricant blend comprises at least a fatty acid, mineral oil and glycerin.

13. The self-contained fibrous buffing article of claim 12 wherein the fatty acid comprises stearic acid and a weight percent of the stearic acid is 5-35 wt. percent.

14. The self-contained fibrous buffing article of claim 12 wherein a density of the nonwoven fabric with the hardened adherent coating comprises from 0.1 $g/cm^3$ to 0.6 $g/cm^3$.

* * * * *